US009547948B1

(12) United States Patent
D'Elia

(10) Patent No.: US 9,547,948 B1
(45) Date of Patent: Jan. 17, 2017

(54) VEHICLE COIN DISPENSER

(71) Applicant: John D'Elia, Worcester, MA (US)

(72) Inventor: John D'Elia, Worcester, MA (US)

( * ) Notice: Subject to any disclaimer, the term of this patent is extended or adjusted under 35 U.S.C. 154(b) by 0 days.

(21) Appl. No.: 15/196,131

(22) Filed: Jun. 29, 2016

(51) Int. Cl.

| | |
|---|---|
| ***G07D 1/00*** | (2006.01) |
| ***G07D 1/02*** | (2006.01) |
| ***G07D 3/04*** | (2006.01) |
| ***G07D 9/06*** | (2006.01) |

(52) U.S. Cl.
CPC *G07D 1/02* (2013.01); *G07D 3/04* (2013.01); *G07D 9/06* (2013.01)

(58) Field of Classification Search
CPC ..... G07D 1/00; G07D 1/02; G07D 3/00; G07D 3/16; G07D 9/00; G07D 9/04; G07D 11/0003; G07D 11/0081; G07D 2201/00
See application file for complete search history.

(56) References Cited

U.S. PATENT DOCUMENTS

| | | | | |
|---|---|---|---|---|
| 3,590,833 | A | 7/1971 | Walton | |
| 4,126,147 | A | 11/1978 | Brisebarre | |
| 5,411,436 | A * | 5/1995 | Kaplan | G07D 1/00 221/94 |
| 5,562,536 | A | 10/1996 | Uchida | |
| 5,895,456 | A | 4/1999 | Beale | |
| 6,267,662 | B1 * | 7/2001 | Jard | G07D 1/00 453/17 |
| 6,889,848 | B2 | 5/2005 | Allison | |
| 2005/0118941 | A1 * | 6/2005 | Navis | G07D 1/00 453/16 |

* cited by examiner

*Primary Examiner* — Mark Beauchaine
(74) *Attorney, Agent, or Firm* — Kyle A. Fletcher, Esq.

(57) ABSTRACT

The vehicle coin dispenser is a device that is adapted for use with one or more coins. The vehicle coin dispenser is adapted for use with a vehicle. The vehicle coin dispenser is mounted on the dashboard of a vehicle. The vehicle coin dispenser receives coins, sorts the coins received by value, counts the coins received, receives a dispense amount request, and dispenses the collected and received coins such that the value of the dispensed coins equals the requested dispense amount. The vehicle coin dispenser comprises a housing and a control system.

17 Claims, 9 Drawing Sheets

VEHICLE COIN DISPENSER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of handling currency, more specifically, a coin dispenser adapted for use with vehicles.

SUMMARY OF INVENTION

The vehicle coin dispenser is a device that is adapted for use with one or more coins. The vehicle coin dispenser is adapted for use with a vehicle. The vehicle coin dispenser is mounted on the dashboard of a vehicle. The vehicle coin dispenser receives coins, sorts the coins received by value, counts the coins received, receives a dispense amount request, and dispenses the collected and received coins such that the value of the dispensed coins equals the requested dispense amount.

These together with additional objects, features and advantages of the vehicle coin dispenser will be readily apparent to those of ordinary skill in the art upon reading the following detailed description of the presently preferred, but nonetheless illustrative, embodiments when taken in conjunction with the accompanying drawings.

In this respect, before explaining the current embodiments of the vehicle coin dispenser in detail, it is to be understood that the vehicle coin dispenser is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the vehicle coin dispenser.

It is therefore important that the claims be regarded as including such equivalent construction insofar as they do not depart from the spirit and scope of the vehicle coin dispenser. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
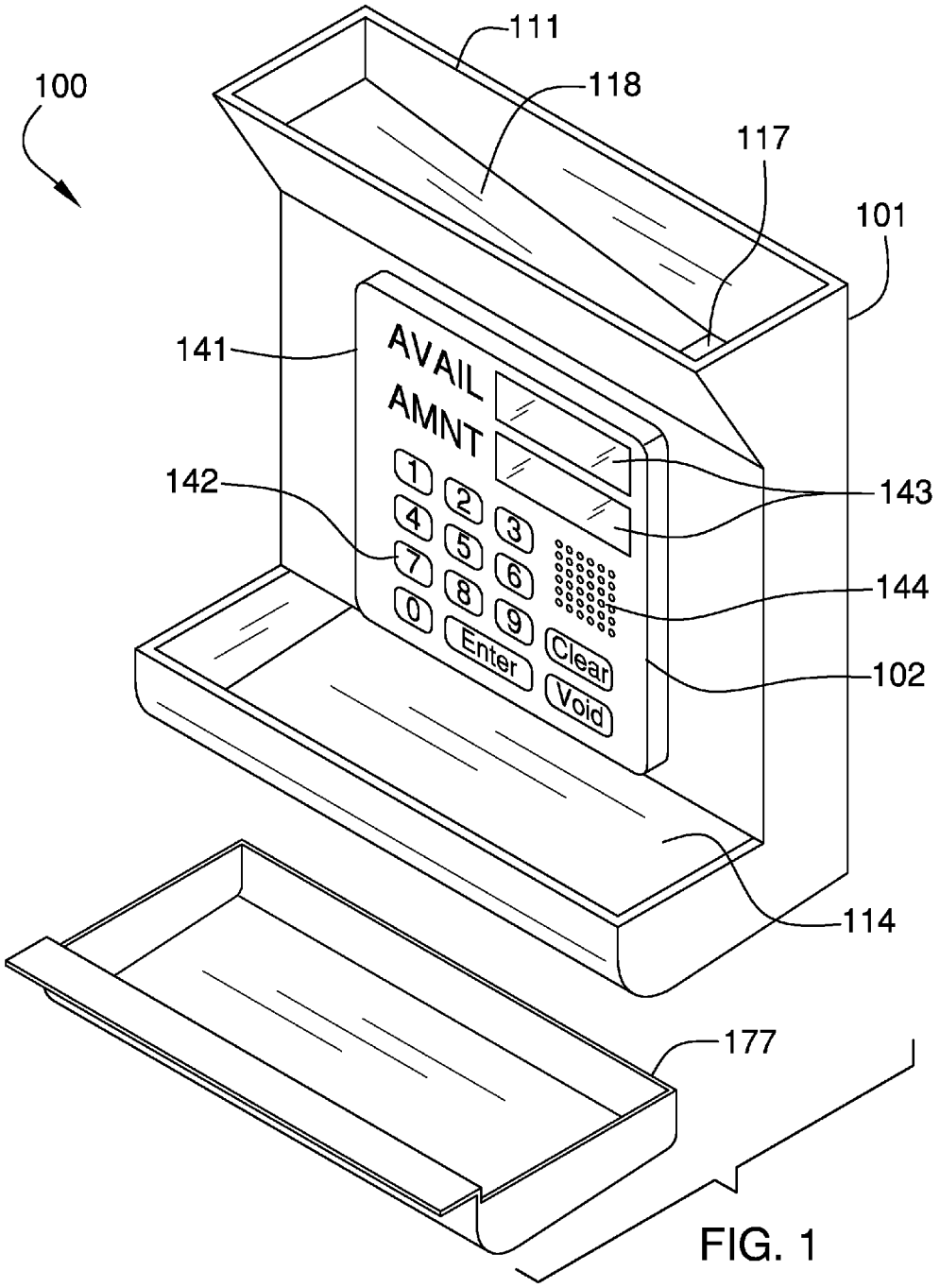
FIG. 1 is a front perspective view of an embodiment of the disclosure.
Figure 2:
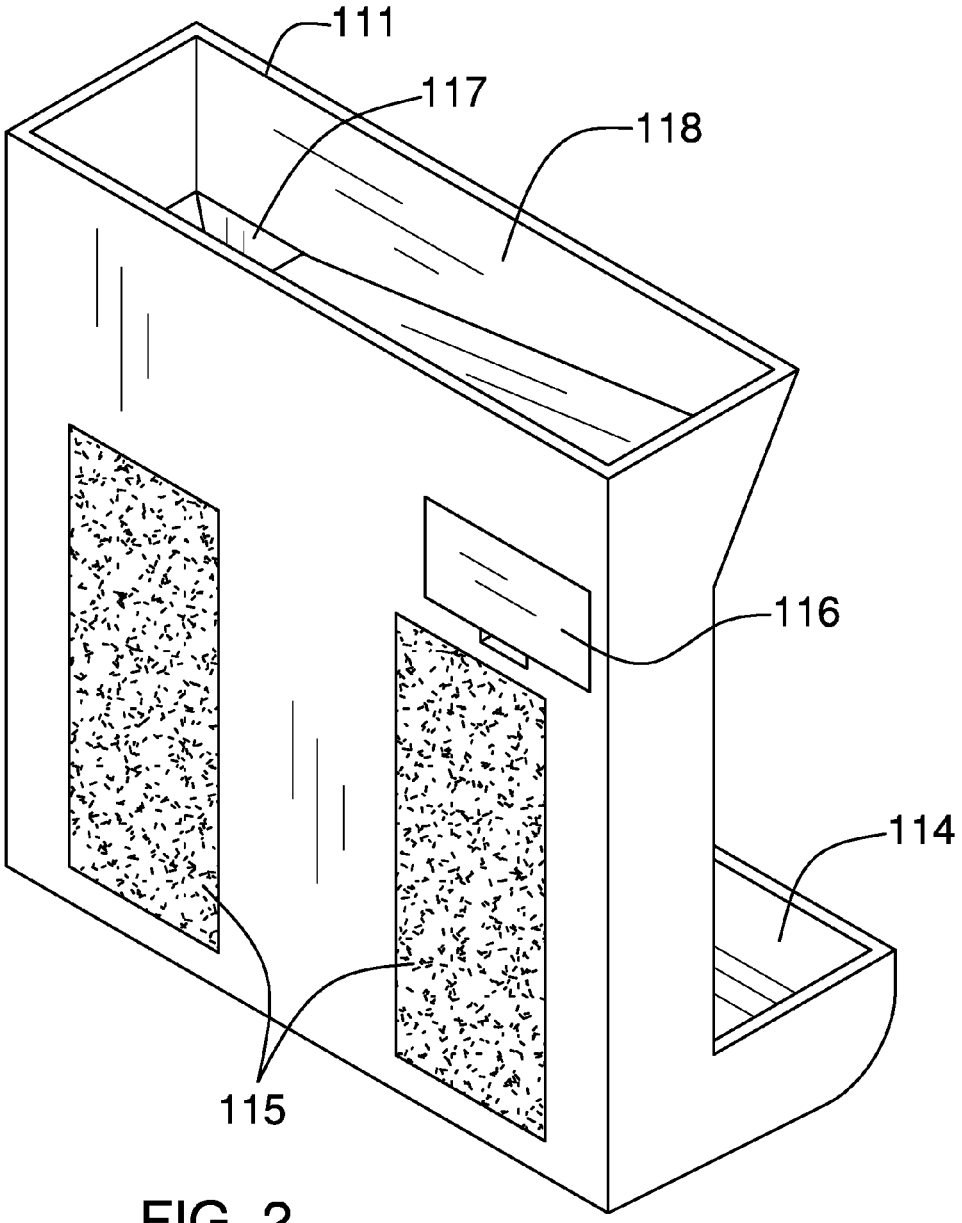
FIG. 2 is a rear perspective view of an embodiment of the disclosure.
Figure 3:
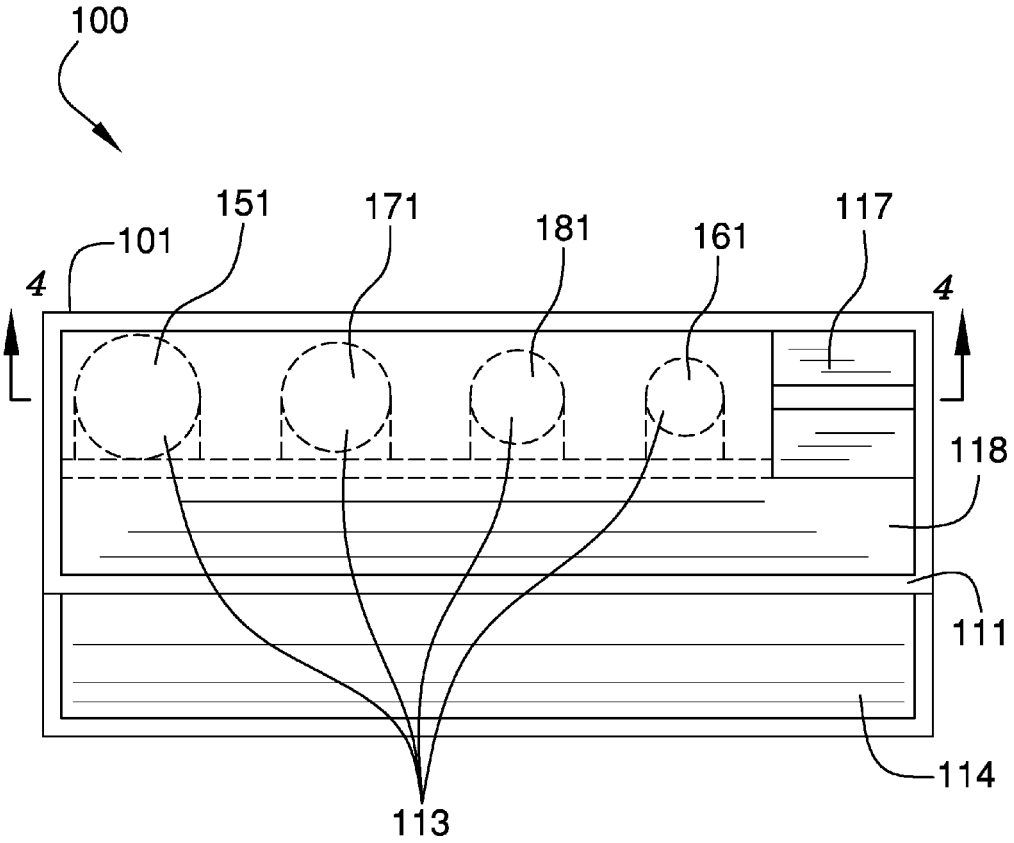
FIG. 3 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 8.

The vehicle coin dispenser 100 (hereinafter invention) comprises a housing 101 and a control system 102. The control system 102 is mounted on the housing 101. The invention 100 is a device that is adapted for use with one or more coins 251 (hereinafter coin or coins). The invention 100 is adapted for use with a vehicle 252. The invention 100 is mounted on the dashboard 253 of a vehicle 252. The invention 100 receives coins 251, sorts the coins 251 received by value, counts the coins 251 received, receives a dispense amount 241 request, and dispenses the collected and received coins 251 such that the value of the dispensed coins 251 equals the requested dispense amount 241.

The housing 101 comprises a hopper 111, a sorting chute 112, a plurality of columns 113, a tray 114, a fastener 115, and a power chamber 116. A removable tray 177 may be provided and is placed against the tray 114 of the housing 101 (see FIGS. 1 and 5). The hopper 111 further comprises a bin 118 and a drain 117. The housing 101 is designed to physically receive, sort, and store coins 251. The hopper 111 receives the coins 251 and transports the coins 251 to the sorting chute 112. The sorting chute 112 sorts coins 251 by size and delivers each coin 251 to a column selected from the plurality of columns 113. The selection of the specific column is based on the size of the coin 251. Each of the plurality of columns 113 stores the received coins 251 and releases the coins 251 into the tray 114 in response to stimulus received from the control system 102. The fastener 115 is a commercially available fastener that is used to attach the housing 101 to the dashboard 253 of the vehicle 252. The power chamber 116 is a chamber formed within the housing 101 that contains a power source 123 that is used to operate the invention 100.

Figure 4:
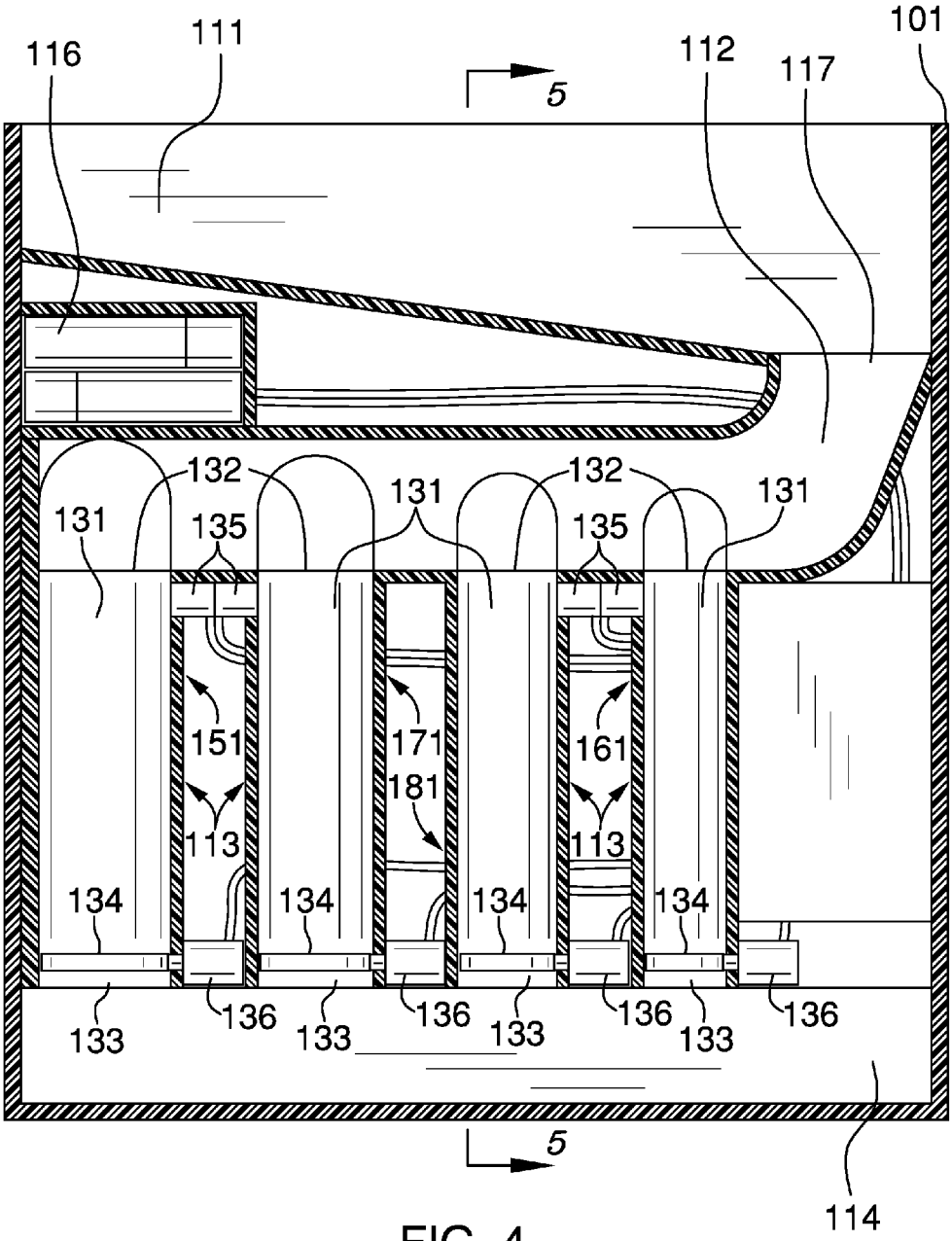
FIG. 4 is a cross-sectional view of an embodiment of the disclosure across 4-4 as shown in FIG. 3.

As shown most clearly in FIGS. 1 and 4, the hopper 111 is a hollow rectilinear bin 118 that is further formed with an open surface. The hopper 111 is intended to receive coins 251 for storage through the open surface. The interior of the hopper 111 has sloped sides that use gravitational forces to move coins 251 through the bin 118 to the drain 117. The drain 117 is an opening that is formed within the bin 118 that passes coins 251 to the sorting chute 112. The sorting chute 112 is a sloped rectilinear structure that uses gravitational forces to move coins 251 along the sorting chute 112. The sorting chute 112 is positioned on top of the first opening 132 of each of the plurality of columns 113. The first opening 132 of each of the plurality of columns 113 is a circular aperture that provides access into the column selected from the plurality of columns 113. The inner diameter of each first opening 132 of each of the plurality of columns 113 is sized to be greater than the outer diameter of a coin 251 of a specific value such that the coin 251 of the specific value will fit through the first opening 132 into the associated column selected from the plurality of columns 113. Each of the plurality of columns 113 receives and stores coins 251 of a specific outer diameter. The coins 251 contained within each of the plurality of columns 113 are tracked by the control system 102 using a plurality of column accumulators 125.

Figure 5:
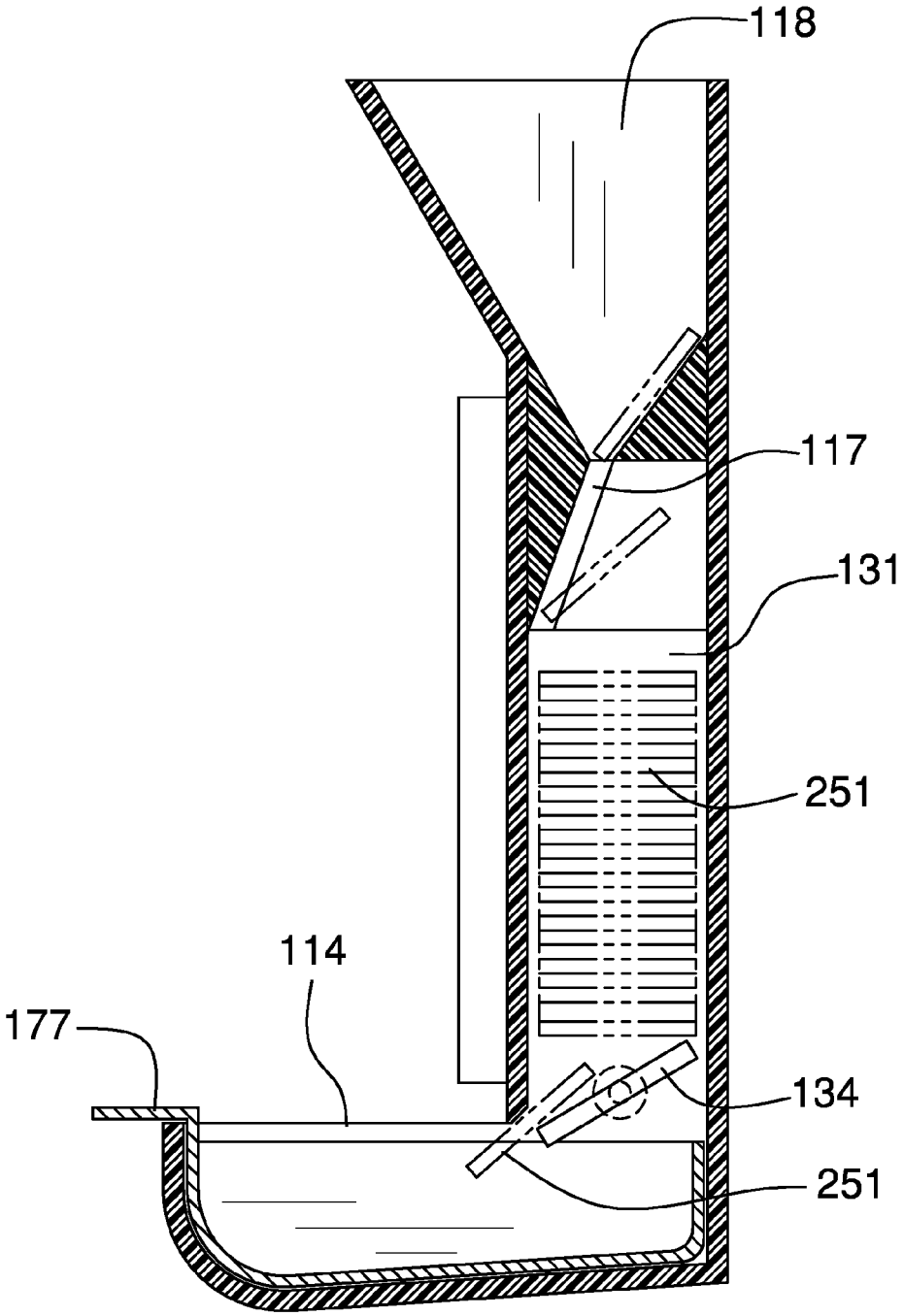
FIG. 5 is a cross-sectional view of an embodiment of the disclosure across 5-5 as shown in FIG. 4.
Figure 6:
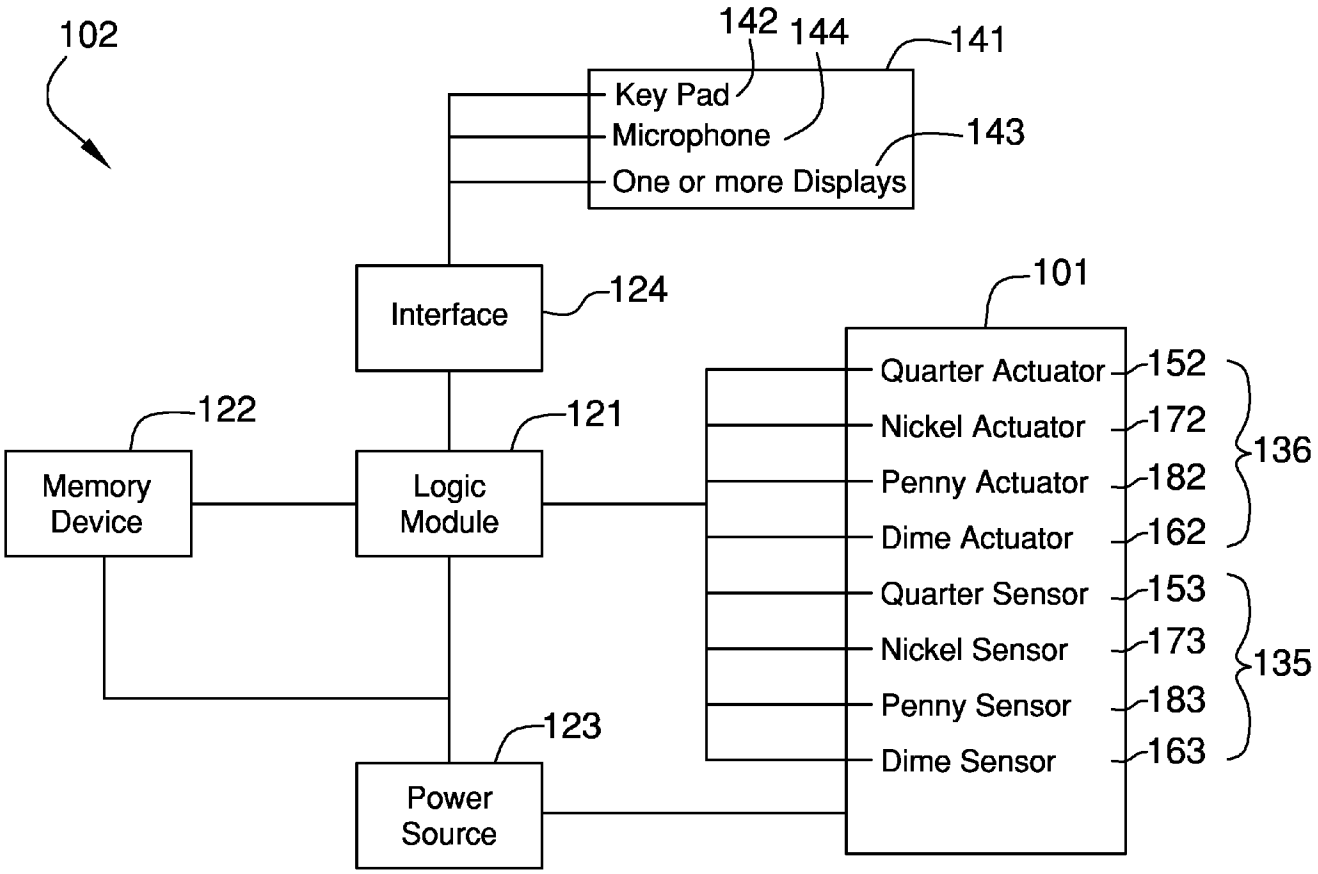
FIG. 6 is a block diagram of an embodiment of the disclosure.
Figure 7A:
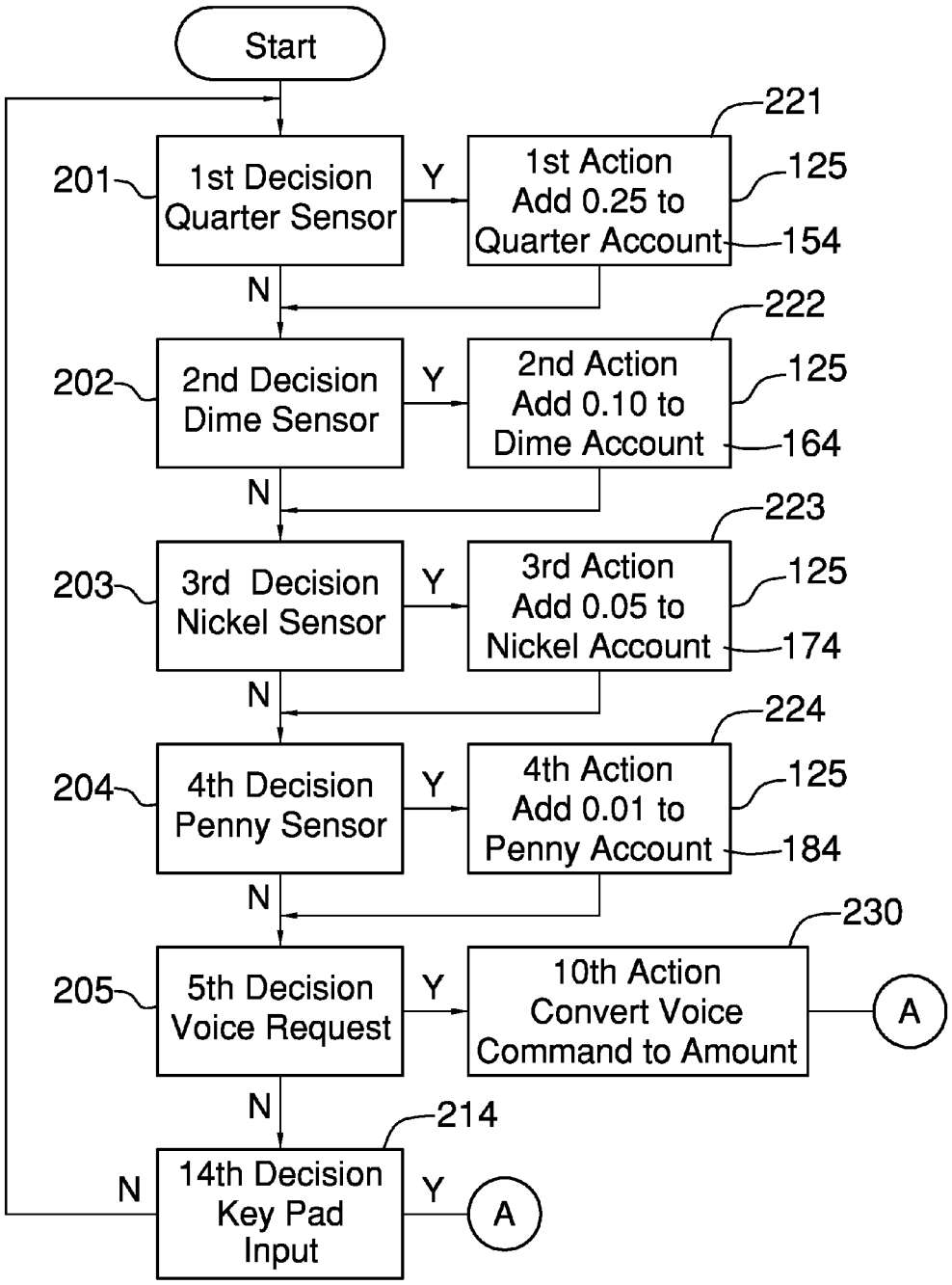
FIG. 7A is a flowchart of an embodiment of the disclosure.
Figure 7B:
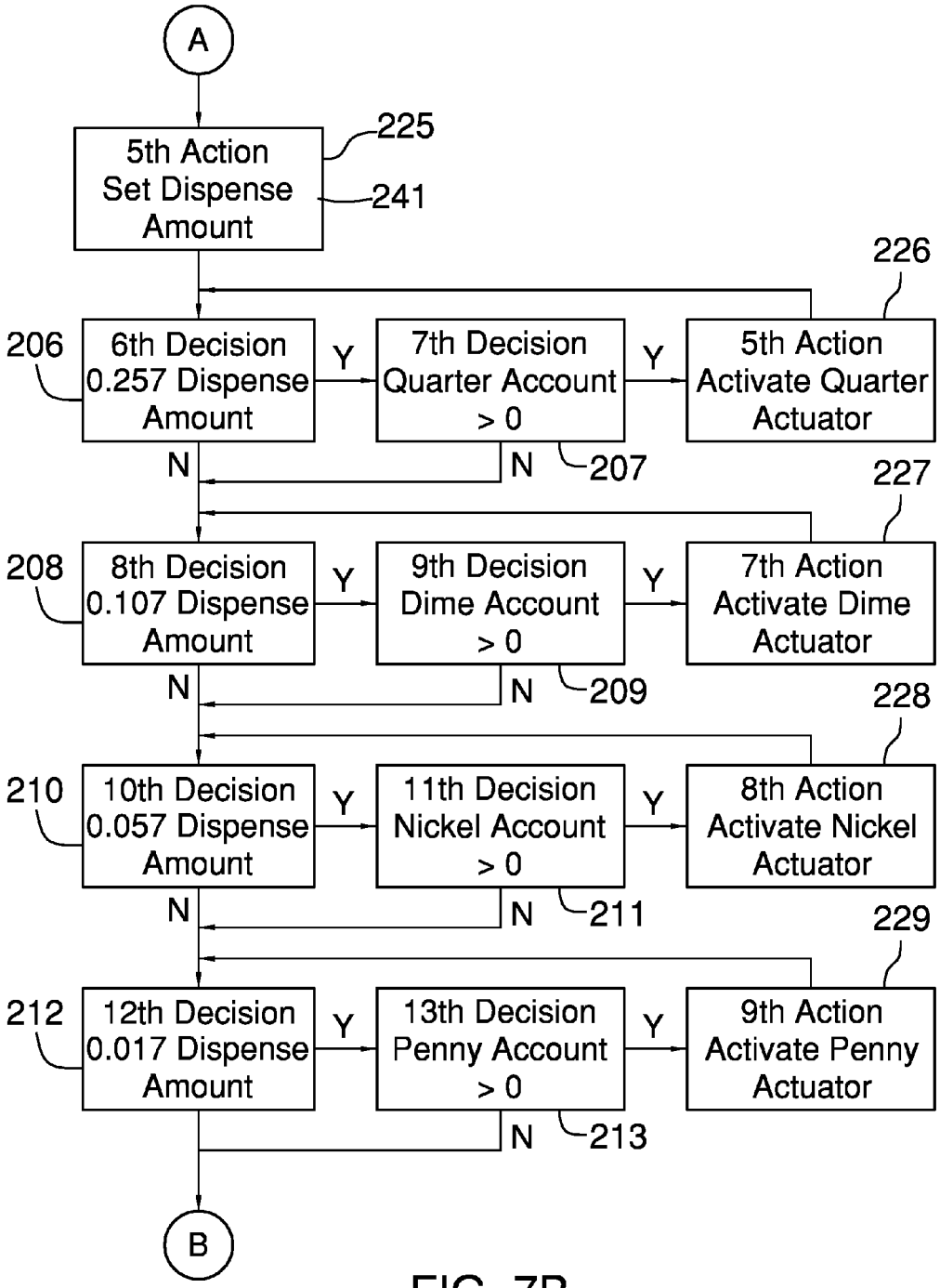
FIG. 7B is a second flowchart of an embodiment of the disclosure.
Figure 8:
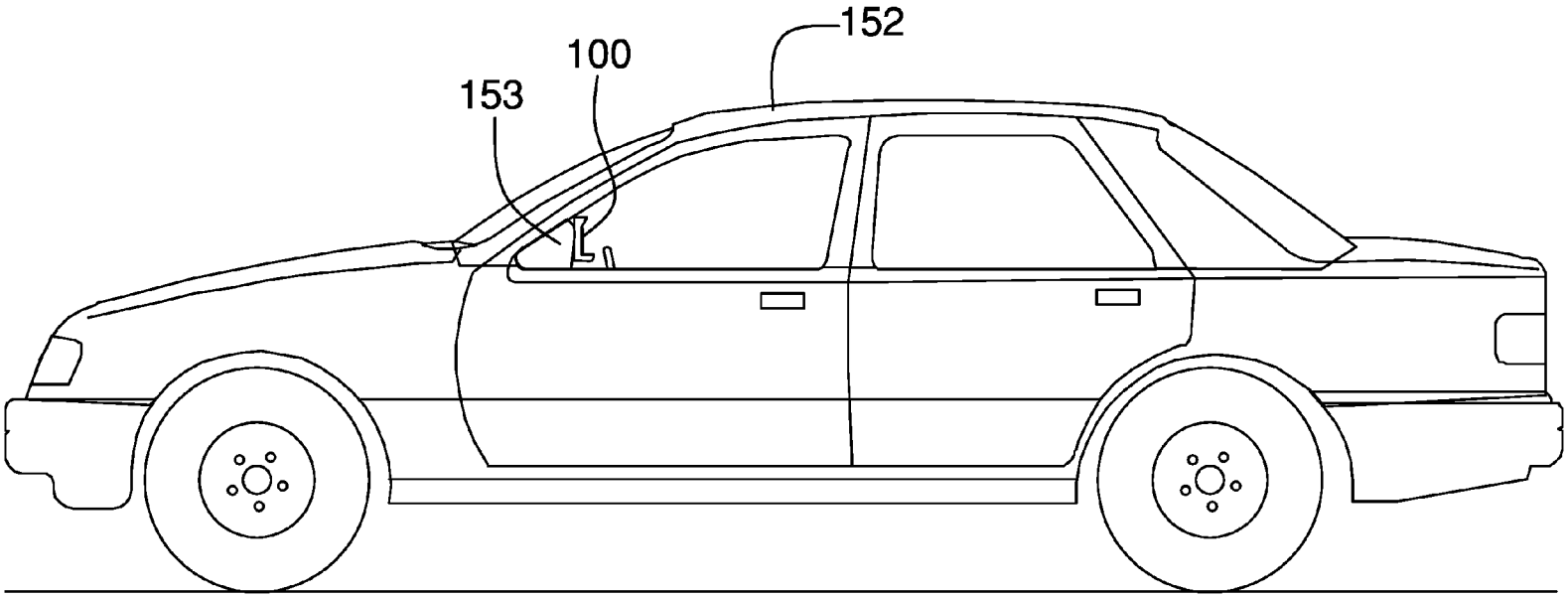
FIG. 8 is an in use view of an embodiment of the disclosure.

The plurality of columns 113 comprises a collection of individual columns. Each individual column is sized to receive and store coins 251 of a specific value. Each of the plurality of columns 113 comprises a cylinder 131, a release plate 134, a sensor 135, and an actuator 136. The cylinder 131 is a right cylindrical structure that is further defined with a first opening 132 and a second opening 133. The first opening 132 is an opening located at a base of the cylinder 131 and is the aperture through which the coin 251 of a specific value will fall to enter the cylinder 131. The second opening 133 is an opening located at the remaining base of the cylinder 131. The release plate 134 is a disk that is positioned such that the release plate 134 prevents a coin 251 that enters the cylinder 131 from escaping from the cylinder 131 until the control system 102 releases the coin 251. Coins 251 released for dispensing will pass through the second opening 133. The inner diameter of the cylinder 131 is sized such that it is greater than the outer diameter of the release plate 134 thereby allowing the release plate 134 to be installed within the cylinder 131 using a pivot. As shown most clearly in FIG. 5, coins 251 are trapped or released within the cylinder 131 by rotating the release plate 134 around the pivot. Coins 251 released for dispensing will pass through the second opening 133 and fall into the tray 114. As shown most clearly in FIG. 4, the sensor 135 is an electrical device that is placed in the general proximity of the first opening 132 such that the sensor 135 will detect a coin 251 entering the cylinder 131. The sensor 135 is monitored by the control system 102. The pivot of the release plate 134 is attached to the actuator 136. The actuator 136 is the device that rotates the release plate 134. The actuator 136 is an electric motor that is used to rotate the actuator 136 such that, as shown in FIG. 5, a coin 251 is able to escape the cylinder 131. The actuator 136 is controlled by the control system 102. In alternate embodiments of the disclosure, the actuator 136 can be a solenoid controlled by the control system 102 and configured such that a coin 251 can be pushed through a slot formed in the face of the cylinder 131.

The coin 251 sorting operation is described in this paragraph. The operating assumption of the invention 100 is that a coin 251 within a currency set can be identified by the size of the outer diameter of the coin 251. Specifically, coins 251 entering the sorting chute 112 are sorted in the following manner. The plurality of columns 113 are positioned in such a sequence that the inner diameter of the first opening 132 of each of the plurality of columns 113 will increase in diameter as a coin 251 entering the sorting chute 112 passes by. The theory of operation of the sorting chute 112 is that as given coin 251 approaches a first opening 132 with in inner diameter greater than the outer diameter of the given coin 251, the given coin 251 will fall through the first opening 132 while larger coins 251 will pass towards first openings 132 with larger inner diameters. Once the coins 251 are separated into a column selected from plurality of columns 113, the coins 251 are released into the tray 114 as described elsewhere within this disclosure.

The control system 102 comprises a logic module 121, a memory device 122, a power source 123, an interface 124, and a plurality of column accumulators 125. The memory device 122 and the interface 124 are connected to the logic module 121. The power source 123 is connected to the logic module 121, the memory device 122, the interface 124 and the actuators 136 and sensors 135 associated with each of the plurality of columns 113. Each of the plurality of column accumulators 125 is a counter that corresponds to a column selected from the plurality of columns 113 that contains a count of the coins 251 contained within the selected column.

The logic module 121 is a readily and commercially available programmable electrical device that is used to control and operate the invention 100. The memory device 122 is a readily and commerically available device that is used to store each of the plurality of column accumulators 125 and the dispense amount 241 for use by the logic module 121. The power source 123 is a commercially available source of electricity that is used power the electrical devices described within this disclosure. The interface 124 is a collection of user interfaces through which: 1) the logic module 121 displays to the user the value of the coins 251 contained within the housing 101; and, 2) the logic module 121 receives from the user the dispense amount 241. The dispense amount 241 is the value of coins 251 that the user would like dispensed from the housing 101.

The interface 124 comprises a panel 141, a keyboard 142, one or more displays 143, and a microphone 144. The keypad 142 is a commercially available numeric keypad into which the user enters the dispense amount 241. The one or more displays 143 are commercially available LCD or LED displays that are used to visually communicate information from the logic module 121 to the user. The microphone 144 is a transducer that receives spoken instruction from the user and converts those spoken instruction to electrical impulses that are monitored by the logic module 121. Using commercially available speech recognition technologies, the logic module 121 interprets the received electrical impulses to determine a dispense amount 241.

In the first potential embodiment of the disclosure, the plurality of columns 113 are designed for US coins 251 and further comprises a quarter column 151, a dime column 161, a nickel column 171, and a penny column 181. The quarter column 151 is further defined with a quarter actuator 152, a quarter sensor 153, and a quarter column accumulator 154.

The quarter actuator 152, the quarter sensor 153, and the quarter column accumulator 154 correspond to the actuator 136, the sensor 135, and the plurality of column accumulators 125 discussed elsewhere in this disclosure. The dime column 161 is further defined with a dime actuator 162, a dime sensor 163, and a dime column accumulator 164. The dime actuator 162, the dime sensor 163, and the dime column accumulator 164 correspond to the actuator 136, the sensor 135, and the plurality of column accumulators 125 discussed elsewhere in this disclosure. The nickel column 171 is further defined with a nickel actuator 172, a nickel sensor 173, and a nickel column accumulator 174. The nickel actuator 172, the nickel sensor 173, and the nickel column accumulator 174 correspond to the actuator 136, the sensor 135, and the plurality of column accumulators 125 discussed elsewhere in this disclosure. The penny column 181 is further defined with a penny actuator 182, a penny sensor 183, and a penny column accumulator 184. The penny actuator 182, the penny sensor 183, and the penny column accumulator 184 correspond to the actuator 136, the sensor 135, and the plurality of column accumulators 125 discussed elsewhere in this disclosure.

In the first potential embodiment of the disclosure, the fastener 115 is a readily and commercially available hook and loop fastener that is attached to the dashboard 253 and the housing 101 with an adhesive. The power source 123 is a readily and commercially available battery that is stored within the power chamber 116. Methods and designs to use batteries are well known in the electrical arts. Methods to use hook and loop fasteners are well known in the textile arts. The logic module 121 is an Arduino based microcontroller. The sensors, and actuators are Arduino based shields. The memory device 122 is a readily and commercially available secure digital card which is commonly referred to as an SD, SDHC or SDXC card. Methodologies to synthesize and implement Arduino designs are well known and documented within the electrical arts. The one or more displays 143 comprises a first LED display and a second LED display upon which the accumulated value of the coins 251 and the dispense amount 241 are displayed respectively.

Those skilled in the mechanical arts and the electrical arts will recognize that the first potential embodiment of the disclosure can be readily modified to accommodate half dollar, dollar coins 251 or coins 251 from other currencies without undue experimentation.

The operation of the first potential embodiment of the disclosure is described in this paragraph and the following 3 paragraphs. The logic module 121 makes a first decision 201 to determine whether the quarter sensor 153 has detected a coin 251 passing into the quarter column 151. If the logic module 121 determines that a coin 251 has passed into the quarter column 151 the logic module 121 takes a first action 221 of adding $0.25 to the amount accumulated in the quarter column accumulator 154 and storing the new amount in the memory device 122 and moves directly to the second decision 202.

If a coin 251 has not passed into the quarter column 151, the logic module 121 makes a second decision 202 to determine whether the dime sensor 163 has detected a coin 251 passing into the dime column 161. If the logic module 121 determines that a coin 251 has passed into the dime column 161 the logic module 121 takes a second action 222 of adding $0.10 to the amount accumulated in the dime column accumulator 164 and storing the new amount in the memory device 122 and moves directly to the third decision 203. If a coin 251 has not passed into the dime column 161, the logic module 121 makes a third decision 203 to determine whether the nickel sensor 173 has detected a coin 251 passing into the nickel column 171. If the logic module 121 determines that a coin 251 has passed into the nickel column 171 the logic module 121 takes a third action 223 of adding $0.05 to the amount accumulated in the nickel column accumulator 174 and storing the new amount in the memory device 122 and moves directly to the fourth decision 204. If a coin 251 has not passed into the nickel column 171 the logic module 121 makes a fourth decision 204 to determine whether the penny sensor 183 has detected a coin 251 passing into the penny column 181. If the logic module 121 determines that a coin 251 has passed into the penny column 181 the logic module 121 takes a fourth action 224 of adding $0.01 to the amount accumulated in the penny column accumulator 184, storing the new amount in the memory device 122, and moving directly to the fifth decision 205.

If a coin 251 has not passed into the penny column 181, the logic module 121 makes a fifth decision 205 to determine whether the microphone 144 has detected a voice command. If the microphone 144 has detected a voice command, the logic module 121 takes a tenth action 230 of converting the voice command received from the microphone 144 into a number and proceeds directly to the fifth action 225. If the microphone 144 has not detected a voice command, the logic module 121 makes a fourteenth decision 214 to determine whether the keypad 142 has received an input. If no input has been received from the keypad 142, the logic module 121 loops back to the first decision 201. If an input has been received through the keypad 142, the logic module 121 proceeds to the fifth action 225.

The logic module 121 takes a fifth action 225 of taking the number received from the group consisting of the number entered by voice command or the number entered by keypad 142 and setting the dispense amount 241 equal to that number and storing the new dispense amount 241 in the memory device 122.

The logic module 121 then makes a sixth decision 206 to determine whether the dispense amount 241 is greater than $0.25. If the dispense amount 241 is greater than this $0.25 threshold, the logic module 121 makes a seventh decision 207 to determine whether the quarter column accumulator 154 has a quarter. If the quarter column accumulator 154 has the quarter, the logic module 121 takes a sixth action 226 of: 1) actuating the quarter actuator 152 to dispense a quarter; 2) deducting $0.25 from the quarter column accumulator 154 and storing the new quarter column accumulator 154 amount in the memory device 122; and, 3) deducting $0.25 from the dispense amount 241 and storing the new dispense amount 241 in the memory device 122. The logic module 121 then loops back to the sixth decision 206. If the dispense amount 241 is less than the $0.25 threshold or if the quarter column accumulator 154 does not have a quarter then the logic module 121 proceeds directly to the eighth decision 208. The logic module 121 makes an eighth decision 208 to determine whether the dispense amount 241 is greater than $0.10. If the dispense amount 241 is greater than this $0.10 threshold, the logic module 121 makes a ninth decision 209 to determine whether the dime column accumulator 164 has a dime.

If the dime column accumulator 164 has the dime, the logic module 121 takes a seventh action 227 of: 1) actuating the dime actuator 162 to dispense a dime; 2) deducting $0.10 from the dime column accumulator 164 and storing the new dime column accumulator 164 amount in the memory device 122; and, 3) deducting $0.10 from the dispense amount 241 and storing the new dispense amount 241 in the memory device 122. The logic module 121 then loops back to the eighth decision 208. If the dispense amount 241 is less than the $0.10 threshold or if the dime column accumulator 164 does not have a dime then the logic module 121 proceeds directly to the tenth decision 210. The logic module 121 makes a tenth decision 210 to determine whether the dispense amount 241 is greater than $0.05. If the dispense amount 241 is greater than this $0.05 threshold, the logic module 121 makes an eleventh decision 211 to determine whether the nickel column accumulator 174 has a nickel. If the nickel column accumulator 174 has the nickel, the logic module 121 takes an eighth action 228 of: 1) actuating the nickel actuator 172 to dispense a nickel; 2) deducting $0.05 from the nickel column accumulator 174 and storing the new nickel column accumulator 174 amount in the memory device 122; and, 3) deducting $0.05 from the dispense amount 241 and storing the new dispense amount 241 in the memory device 122. The logic module 121 then loops back to the tenth decision 210.

If the dispense amount 241 is less than the $0.05 threshold or if the nickel column accumulator 174 does not have a nickel then the logic module 121 proceeds directly to the twelfth decision 212. The logic module 121 makes a twelfth decision 212 to determine whether the dispense amount 241 is greater than $0.01. If the dispense amount 241 is greater than this $0.01 threshold, the logic module 121 makes a thirteenth decision 213 to determine whether the penny column accumulator 184 has a penny. If the penny column accumulator 184 has the penny, the logic module 121 takes a ninth action 229 of: 1) actuating the penny actuator 182 to dispense a penny; 2) deducting $0.01 from the penny column accumulator 184 and storing the new penny column accumulator 184 amount in the memory device 122; and, 3) deducting $0.01 from the dispense amount 241 and storing the new dispense amount 241 in the memory device 122. The logic module 121 then loops back to the twelfth decision 212. If the dispense amount 241 is less than the $0.01 threshold or if the penny column accumulator 184 does not have a penny then the logic module 121 proceeds loops directly back to the first decision 201.

The following definitions were used in this disclosure:

Correspond: As used in this disclosure, the term correspond means that a first object is in some manner linked to a second object in a one to one fashion.

Cylinder: As used in this disclosure, a cylinder is a geometric structure defined by two identical flat and parallel ends, also commonly referred to as bases, which are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Electric Motor: In this disclosure, an electric motor is a machine that converts electric energy into rotational mechanical energy.

Fastener: As used in this disclosure, a fastener is a device that is used to join or affix two objects. Fasteners generally comprise a first element which is attached to the first object and a second element which is attached to the second object such that the first element and the second element join to affix the first object and the second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Inner Diameter: As used in this disclosure, the term inner diameter is used in the same way that a plumber would refer to the inner diameter of a pipe.

Logic Module: As used in this disclosure, a logic module is an electrical device that is programmable and that accepts digital and analog inputs, processes the digital and analog inputs according to previously stored instruction and to provide the results of these instructions as digital or analog outputs.

Microphone: As used in this disclosure, a microphone is an electrical device that converts an audible sound into an electrical signal.

Motor: As used in this disclosure, a motor refers to the method of transferring energy from the external power source into mechanical energy.

Outer Diameter: As used in this disclosure, the term outer diameter is used in the same way that a plumber would refer to the outer diameter of a pipe.

Pivot: As used in this disclosure, a pivot is a rod or shaft around which an object rotates or swings.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Transducer: As used in this disclosure, a transducer is a device that converts a physical quantity, such as pressure or brightness into an electrical signal or a device that converts an electrical signal into a physical quantity.

Vehicle: As used in this disclosure, a vehicle is a device that is used transporting carrying passengers, goods, or equipment. The term motorized vehicle refers to a vehicle can move under power provided by an electric motor or an internal combustion engine.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and

What is claimed is:

1. A coin management device comprising:

a housing and a control system;

wherein the control system is mounted on the housing;

wherein the coin management device is adapted for use with one or more coins;

wherein the coin management device is adapted for use with a vehicle;

wherein the coin management device is mounted on the dashboard of a vehicle;

wherein the coin management device receives coins;

wherein the coin management device sorts the coins received by value;

wherein the coin management device counts the coins received;

wherein the coin management device receives a dispense amount request;

wherein the coin management device dispenses the received coins such that the value of the dispensed one or more coins equals the requested dispense amount;

wherein the housing comprises a hopper, a sorting chute, a plurality of columns, a tray, a fastener, and a power chamber;

wherein the hopper further comprises a bin and a drain;

wherein the drain attaches the hopper to the sorting chute;

wherein the sorting chute attaches to the plurality of columns;

wherein the plurality of columns attach to the tray;

wherein the fastener attaches the housing to the dashboard of the vehicle;

wherein the power chamber is a chamber formed within the housing;

wherein the hopper to physically receives coins;

wherein the hopper transports coins to the sorting chute;

wherein the sorting chute physically sorts coins;

wherein the sorting chute transfers coins to the plurality of columns;

wherein the plurality of columns physically stores coins;

wherein each of the plurality of columns releases the stored coins into the tray in response to stimulus received from the control system.

2. The coin management device according to claim 1 wherein the sorting chute sorts coins by size and delivers each coin to a column selected from the plurality of columns.

3. The coin management device according to claim 2 wherein each of the plurality of columns releases the stored coins into the tray in response to stimulus received from the control system.

4. The coin management device according to claim 3 wherein the hopper is a hollow rectilinear bin;

wherein the interior of the hopper has sloped sides that use gravitational forces to move coins through the bin to the drain;

wherein the sorting chute is a sloped rectilinear structure that uses gravitational forces to move coins along the sorting chute;

wherein the drain is an opening that is formed within the bin that passes coins to the sorting chute.

5. The coin management device according to claim 4 wherein the plurality of columns comprises a collection of individual columns;

wherein each individual column is sized to receive and store coins of a specific value;

wherein each of the plurality of columns comprises a cylinder, a release plate, a sensor, and an actuator;

wherein the cylinder is a right cylindrical structure that is further defined with a first opening and a second opening;

wherein the first opening is a first aperture through which the coin of a specific value will fall to enter the cylinder;

wherein the second opening is a second aperture;

wherein the release plate is a disk that is positioned such that the release plate prevents a coin that enters the cylinder from escaping from the cylinder until the control system releases the coin;

wherein the coins released for dispensing will pass through the second opening and fall into the tray;

wherein the inner diameter of the cylinder is sized such that it is greater than the outer diameter of the release plate;

wherein the release plate is installed within the cylinder using a pivot;

wherein the sensor is an electrical device that is positioned such that the sensor will detect a coin entering the cylinder;

wherein the sensor is monitored by the control system;

wherein the pivot of the release plate is attached to the actuator;

wherein the actuator is the device that rotates the release plate;

wherein the actuator is controlled by the control system.

6. The coin management device according to claim 5 wherein the control system comprises a logic module, a memory device, a power source, an interface, and a plurality of column accumulators;

wherein the memory device and the interface are connected to the logic module;

wherein the power source is connected to the logic module, the memory device, the interface and the actuator of each column selected from the plurality of columns, and the sensor of each column selected from the plurality of columns;

wherein the power source is stored within the power chamber;

wherein each of the plurality of column accumulators is a counter that corresponds to a column selected from the plurality of columns that contains a count of the coins contained within the selected column.

7. The coin management device according to claim 6 wherein the memory device is used to store each of the plurality of column accumulators and the dispense amount for use by the logic module.

8. The coin management device according to claim 7 wherein the interface comprises a panel, a keyboard, one or more displays, and a microphone;

wherein the keyboard, the one or more displays, and the microphone are mounted on the panel;

wherein the panel is mounted on the housing.

9. The coin management device according to claim 8 wherein the logic module is a programmable electrical device.

10. The coin management device according to claim 8 wherein the plurality of columns further comprises a quarter column, a dime column, a nickel column, and a penny column;

wherein the quarter column is further defined with a quarter actuator, a quarter sensor, and a quarter column accumulator;

wherein the quarter actuator, the quarter sensor, and the quarter column accumulator correspond to the actuator, the sensor, and the plurality of column accumulators respectively;

wherein the dime column is further defined with a dime actuator, a dime sensor, and a dime column accumulator;

wherein the dime actuator, the dime sensor, and the dime column accumulator correspond to the actuator, the sensor, and the plurality of column accumulators respectively;

wherein the nickel column is further defined with a nickel actuator, a nickel sensor, and a nickel column accumulator;

wherein the nickel actuator, the nickel sensor, and the nickel column accumulator correspond to the actuator, the sensor, and the plurality of column accumulators respectively;

wherein the penny column is further defined with a penny actuator, a penny sensor, and a penny column accumulator;

wherein the penny actuator, the penny sensor, and the penny column accumulator correspond to the actuator, the sensor, and the plurality of column accumulators respectively.

11. The coin management device according to claim 10 wherein the logic module is a programmable electrical device.

12. The coin management device according to claim 10 wherein the logic module is a programmable electrical device;

wherein the logic module makes a first decision to determine whether the quarter sensor has detected a coin passing into the quarter column;

wherein the logic module takes a first action of adding $0.25 to an amount accumulated in the quarter column accumulator and storing the new amount in the memory device;

wherein the logic module makes a second decision to determine whether the dime sensor has detected a coin passing into the dime column;

wherein the logic module takes a second action of adding $0.10 to the amount accumulated in the dime column accumulator and storing the new amount in the memory device;

wherein the logic module makes a third decision to determine whether the nickel sensor has detected a coin passing into the nickel column;

wherein the logic module takes a third action of adding $0.05 to the amount accumulated in the nickel column accumulator and storing the new amount in the memory device;

wherein the logic module makes a fourth decision to determine whether the penny sensor has detected a coin passing into the penny column;

wherein the logic module takes a fourth action of adding $0.01 to the amount accumulated in the penny column accumulator and storing the new amount in the memory device;

wherein the logic module makes a fifth decision to determine whether the microphone has detected a voice command;

wherein the logic module takes a tenth action of converting the voice command received from the microphone into a number;

wherein the logic module makes a fourteenth decision to determine whether the keypad has received an input;

wherein the logic module takes a fifth action of taking the number received from the group consisting of the number entered by voice command or the number entered by keypad and setting the dispense amount equal to that number and storing the new dispense amount in the memory device;

wherein the logic module logic module then makes a sixth decision to determine whether the dispense amount is greater than $0.25;

wherein the logic module makes a seventh decision to determine whether the quarter column accumulator has a quarter;

wherein the logic module takes a sixth action of: 1) actuating the quarter actuator to dispense a quarter; 2) deducting $0.25 from the quarter column accumulator and storing the new quarter column accumulator amount in the memory device; and, 3) deducting $0.25 from the dispense amount and storing the new dispense amount in the memory device;

wherein the logic module makes an eighth decision to determine whether the dispense amount is greater than $0.10;

wherein the logic module makes a ninth decision to determine whether the dime column accumulator has a dime;

wherein the logic module takes a seventh action of: 1) actuating the dime actuator to dispense a dime; 2) deducting $0.10 from the dime column accumulator and storing the new dime column accumulator amount in the memory device; and, 3) deducting $0.10 from the dispense amount and storing the new dispense amount in the memory device;

wherein the logic module makes a tenth decision to determine whether the dispense amount is greater than $0.05;

wherein the logic module makes an eleventh decision to determine whether the nickel column accumulator has a nickel;

wherein the logic module takes an eighth action of: 1) actuating the nickel actuator to dispense a nickel; 2) deducting $0.05 from the nickel column accumulator and storing the new nickel column accumulator amount in the memory device; and, 3) deducting $0.05 from the dispense amount and storing the new dispense amount in the memory device;

wherein the logic module makes a twelfth decision to determine whether the dispense amount is greater than $0.01;

wherein the logic module makes a thirteenth decision to determine whether the penny column accumulator has a penny;

wherein the logic module takes a ninth action of: 1) actuating the penny actuator to dispense a penny; 2) deducting $0.01 from the penny column accumulator and storing the new penny column accumulator amount in the memory device; and, 3) deducting $0.01 from the dispense amount and storing the new dispense amount in the memory device.

13. The coin management device according to claim 1 wherein the control system comprises a logic module, a memory device, a power source, an interface, and a plurality of column accumulators;

wherein the memory device and the interface are connected to the logic module;

wherein the power source is connected to the logic module, the memory device, the interface and the actuator of each column selected from the plurality of columns, and the sensor of each column selected from the plurality of columns;

wherein the power source is stored within a power chamber;

wherein each of the plurality of column accumulators is a counter that corresponds to a column selected from the plurality of columns that contains a count of the coins contained within the selected column;

wherein the memory device is used to store each of the plurality of column accumulators and the dispense amount for use by the logic module;

wherein the interface comprises a panel, a keyboard, one or more displays, and a microphone;

wherein the keyboard, the one or more displays, and the microphone are mounted on the panel;

wherein the panel is mounted on the housing;

wherein the logic module is a programmable electrical device;

wherein the housing comprises a hopper, a sorting chute, a plurality of columns, a tray, a fastener, and a power chamber;

wherein the hopper further comprises a bin and a drain;

wherein the drain attaches the hopper to the sorting chute;

wherein the sorting chute attaches to the plurality of columns;

wherein the plurality of columns attach to the tray;

wherein the fastener attaches the housing to the dashboard of the vehicle;

wherein the power chamber is a chamber formed within the housing;

wherein the hopper to physically receives coins;

wherein the hopper transports coins to the sorting chute;

wherein the sorting chute physically sorts coins;

wherein the sorting chute transfers coins to the plurality of columns;

wherein the plurality of columns physically stores coins;

wherein each of the plurality of columns releases the stored coins into the tray in response to stimulus received from the control system;

wherein the sorting chute sorts coins by size and delivers each coin to a column selected from the plurality of columns;

wherein each of the plurality of columns releases the stored coins into the tray in response to stimulus received from the control system;

wherein the hopper is a hollow rectilinear bin;

wherein the interior of the hopper has sloped sides that use gravitational forces to move coins through the bin to the drain;

wherein the sorting chute is a sloped rectilinear structure that uses gravitational forces to move coins along the sorting chute;

wherein the drain is an opening that is formed within the bin that passes coins to the sorting chute;

wherein the plurality of columns comprises a collection of individual columns;

wherein each individual column is sized to receive and store coins of a specific value;

wherein each of the plurality of columns comprises a cylinder, a release plate, a sensor, and an actuator;

wherein the cylinder is a right cylindrical structure that is further defined with a first opening and a second opening;

wherein the first opening is a first aperture through which the coin of a specific value will fall to enter the cylinder;

wherein the second opening is a second aperture;

wherein the release plate is a disk that is positioned such that the release plate prevents a coin that enters the cylinder from escaping from the cylinder until the control system releases the coin;

wherein the coins released for dispensing will pass through the second opening and fall into the tray;

wherein the inner diameter of the cylinder is sized such that it is greater than the outer diameter of the release plate;

wherein the release plate is installed within the cylinder using a pivot;

wherein the sensor is an electrical device that is positioned such that the sensor will detect a coin entering the cylinder;

wherein the sensor is monitored by the control system;

wherein the pivot of the release plate is attached to the actuator;

wherein the actuator is the device that rotates the release plate;

wherein the actuator is controlled by the control system.

14. The coin management device according to claim 13 wherein the plurality of columns further comprises a quarter column, a dime column, a nickel column, and a penny column;

wherein the quarter column is further defined with a quarter actuator, a quarter sensor, and a quarter column accumulator;

wherein the quarter actuator, the quarter sensor, and the quarter column accumulator correspond to the actuator, the sensor, and the plurality of column accumulators respectively;

wherein the dime column is further defined with a dime actuator, a dime sensor, and a dime column accumulator;

wherein the dime actuator, the dime sensor, and the dime column accumulator correspond to the actuator, the sensor, and the plurality of column accumulators respectively;

wherein the nickel column is further defined with a nickel actuator, a nickel sensor, and a nickel column accumulator;

wherein the nickel actuator, the nickel sensor, and the nickel column accumulator correspond to the actuator, the sensor, and the plurality of column accumulators respectively;

wherein the penny column is further defined with a penny actuator, a penny sensor, and a penny column accumulator;

wherein the penny actuator, the penny sensor, and the penny column accumulator correspond to the actuator, the sensor, and the plurality of column accumulators respectively.

15. The coin management device according to claim 13 wherein the logic module is a programmable electrical device;

wherein the logic module makes a first decision to determine whether a sensor associated with each of the plurality of columns has detected a coin;

wherein the logic module takes a first action of incrementing a column accumulator selected from the plurality of column accumulators and storing the incremented amount in the memory device;

wherein the logic module determines whether the microphone has detected a voice command;

wherein the logic module converts the voice command received from the microphone into a number;

wherein the logic module determines whether the keypad has received an input;

wherein the logic module selects a number received from the group consisting of the number entered by voice command or the number entered by keypad and sets the dispense amount equal to that number and storing the new dispense amount in the memory device;

wherein the logic module then compares the dispense amount to the value of a coin;

wherein the logic module determines whether the a column selected from the plurality of columns contains the coin;

wherein the logic module dispenses the coin.

16. The coin management device according to claim 15 wherein the housing comprises a hopper, a sorting chute, a plurality of columns, a tray, a fastener, and a power chamber;

wherein the hopper further comprises a bin and a drain;

wherein the drain attaches the hopper to the sorting chute;

wherein the sorting chute attaches to the plurality of columns;

wherein the plurality of columns attach to the tray;

wherein the fastener attaches the housing to the dashboard of the vehicle;

wherein the power chamber is a chamber formed within the housing;

wherein the hopper to physically receives coins;

wherein the hopper transports coins to the sorting chute;

wherein the sorting chute physically sorts coins;

wherein the sorting chute transfers coins to the plurality of columns;

wherein the plurality of columns physically stores coins;

wherein each of the plurality of columns releases the stored coins into the tray in response to stimulus received from the control system;

wherein the sorting chute sorts coins by size and delivers each coin to a column selected from the plurality of columns;

wherein each of the plurality of columns releases the stored coins into the tray in response to stimulus received from the control system;

wherein the hopper is a hollow rectilinear bin;

wherein the interior of the hopper has sloped sides that use gravitational forces to move coins through the bin to the drain;

wherein the sorting chute is a sloped rectilinear structure that uses gravitational forces to move coins along the sorting chute;

wherein the drain is an opening that is formed within the bin that passes coins to the sorting chute;

wherein the plurality of columns comprises a collection of individual columns;

wherein each individual column is sized to receive and store coins of a specific value;

wherein each of the plurality of columns comprises a cylinder, a release plate, a sensor, and an actuator;

wherein the cylinder is a right cylindrical structure that is further defined with a first opening and a second opening;

wherein the first opening is a first aperture through which the coin of a specific value will fall to enter the cylinder;

wherein the second opening is a second aperture;

wherein the release plate is a disk that is positioned such that the release plate prevents a coin that enters the cylinder from escaping from the cylinder until the control system releases the coin;

wherein the coins released for dispensing will pass through the second opening and fall into the tray;

wherein the inner diameter of the cylinder is sized such that it is greater than the outer diameter of the release plate;

wherein the release plate is installed within the cylinder using a pivot;

wherein the sensor is an electrical device that is positioned such that the sensor will detect a coin entering the cylinder;

wherein the sensor is monitored by the control system;

wherein the pivot of the release plate is attached to the actuator;

wherein the actuator is the device that rotates the release plate;

wherein the actuator is controlled by the control system.

17. The coin management device according to claim 16 wherein the plurality of columns further comprises a quarter column, a dime column, a nickel column, and a penny column;

wherein the quarter column is further defined with a quarter actuator, a quarter sensor, and a quarter column accumulator;

wherein the quarter actuator, the quarter sensor, and the quarter column accumulator correspond to the actuator, the sensor, and the plurality of column accumulators respectively;

wherein the dime column is further defined with a dime actuator, a dime sensor, and a dime column accumulator;

wherein the dime actuator, the dime sensor, and the dime column accumulator correspond to the actuator, the sensor, and the plurality of column accumulators respectively;

wherein the nickel column is further defined with a nickel actuator, a nickel sensor, and a nickel column accumulator;

wherein the nickel actuator, the nickel sensor, and the nickel column accumulator correspond to the actuator, the sensor, and the plurality of column accumulators respectively;

wherein the penny column is further defined with a penny actuator, a penny sensor, and a penny column accumulator;

wherein the penny actuator, the penny sensor, and the penny column accumulator correspond to the actuator, the sensor, and the plurality of column accumulators respectively.

* * * * *